United States Patent [19]

Dornier

[11] Patent Number: 4,546,803

[45] Date of Patent: Oct. 15, 1985

[54] RELIEF MEANS FOR THE DRIVE MECHANISMS OF COMPONENTS ALTERNATINGLY ROCKING BETWEEN TWO END POSITIONS

[75] Inventor: Peter Dornier, Lindau, Fed. Rep. of Germany

[73] Assignee: Lindauer Dornier Gesellschaft mbH, Lindau, Fed. Rep. of Germany

[21] Appl. No.: 530,009

[22] Filed: Sep. 7, 1983

[30] Foreign Application Priority Data

Jul. 15, 1983 [DE] Fed. Rep. of Germany ..... 3325591

[51] Int. Cl.[4] ..... D03D 47/00; D03D 49/60

[52] U.S. Cl. ..... 139/449; 139/191

[58] Field of Search ..... 139/449, 190, 191, 440, 139/441, 443, 444, 445

[56] References Cited

U.S. PATENT DOCUMENTS

| | | | |
|---|---|---|---|
| 1,695,388 | 12/1928 | Robertson | 139/449 X |
| 4,076,048 | 2/1978 | Bolleter et al. | 139/190 |
| 4,427,037 | 1/1984 | Hill | 139/449 |

FOREIGN PATENT DOCUMENTS

| | | | |
|---|---|---|---|
| 147501 | 3/1903 | Fed. Rep. of Germany . | |
| 2808202 | 9/1979 | Fed. Rep. of Germany . | |
| 399026 | 10/1942 | Italy | 139/190 |
| 633950 | 11/1978 | U.S.S.R. | 139/449 |

*Primary Examiner*—Henry S. Jaudon
*Assistant Examiner*—T. Graveline
*Attorney, Agent, or Firm*—W. G. Fasse; D. H. Kane, Jr.

[57] ABSTRACT

This system is intended for relieving the drives of weaving machine components alternatingly rocking between two end positions, for instance a first rocking member forming a gripper rod drive and a second rocking member forming a reed drive. A common energy storing device, for instance a spring, is connected with the two separate drive units, so that each end of the spring is connected to one of the two separate rocking members. The rocking motions of the two rocking drive members do not overlap in time.

5 Claims, 3 Drawing Figures

RELIEF MEANS FOR THE DRIVE MECHANISMS OF COMPONENTS ALTERNATINGLY ROCKING BETWEEN TWO END POSITIONS

FIELD OF THE INVENTION

This invention relates to a relief means for the drive mechanisms in weaving machinery which alternatingly move between two end positions.

DESCRIPTION OF THE PRIOR ART

Such a device can be used, for example, in weaving machines with respect to the reciprocating gripper rods for the filling yarn insertion and the reed for the beating-up or slinging of the inserted filling yarn. In both instances, the components must be moved in the shortest possible time from one end position to the other and then be returned into their initial positions. Substantial masses must be accelerated and again decelerated. This is especially the case when driving the reed.

In weaving machinery, the drive is powered from a constantly rotating main drive shaft by means of eccentrics or cranks. Modern machines generally employ complementary double cams which operate substantially free of play. Appreciable forces must be produced by these eccentrics and be transmitted directly or indirectly, possibly with the insertion of further components, through roller levers, to rocking components, for instance to the reed. Regarding the desirable increase in machine output, this problem becomes rather significant increasing the drive speed also increases the forces whereby the stresses exerted on the components require, in turn, larger sizes and hence increases in the moving masses.

A problem larger than that caused by the magnitude of the forces to be applied, however, is raised by the fact that the forces of acceleration and deceleration generate a rotational non-uniformity. Such non-uniformity is an added undesirable drawback because it generates vibrations and shocks in the machine and high peak loads for the drive.

German Pat. No. 147,501 discloses a solution for this problem. A spring is stressed during the return of the sley, this spring being fastened at one end to an arm of the sley and at the other end to the frame of the loom. By stressing the spring, the weight of the sley is meant to be compensated and the pressure exerted by the sley on the associated crank and also on the articulation and crank pins is intended to be eliminated. During the beat-up or slinging motion of the sley the spring stress is supporting and again eliminates the pressure on the crank shaft, the articulation and crank pins. No force is intended to be exerted any longer by the crank shaft during the forward and backward motions of the sley, but only guidance is to be provided.

Whereas the above German Pat. No. 147,501 describes a simple spring means mounted between a reciprocating component, that is the sley, and the fixed frame, and alternates between the tensioned and the unstressed state, German Patent Publication No. 2,808,202 discloses a system with a doubly acting spring arrangement. A pair of mutually opposite springs is fixed at one end from mutually opposite sides to the reed and with the other end each spring is connected to the weaving machine frame. This known system is in the unstressed state for a middle position of the sley. After each beat-up or slinging motion, the reed is moved into its rear position where it is hydraulically locked in place. Only after unlocking is it possible for the reed to carry out a new beat-up or slinging motion, the stored spring energy being applied to accelerate the reed.

Both known systems disclose solutions applying to the reed drive only but cannot be transferred to other reciprocating or oscillating parts. A simple storage of energy, as disclosed in German Pat. No. 147,501 inherently is less effective than a double energy storage device which is free of stress when the rocking component is in a central position while reinforcing the component acceleration when in either end position, as for instance in the above-cited German Patent Publication No. 2,808,202. The latter system has the drawback, however, that the hydraulic lock and the release control of the reed require an undesired expense. Furthermore, dual-acting energy storing means with two springs in each case often are difficult to mount in a weaving machine.

OBJECTS OF THE INVENTION

Based on this state of the art of spring-loaded elements acting as energy storing means the invention addresses the problem of providing a system making it possible to reduce as much as possible, and at the least cost, the forces to be transmitted to other oscillating components from the constantly rotating drive, for instance from the excenter cams, whereby the cited drawbacks are eliminated as much as possible.

SUMMARY OF THE INVENTION

The invention solves this problem by providing a single energy-storing means connected at both ends thereof to a respective oscillating or moving member, the oscillating motions of the moving members being substantially free of overlap. Various embodiments can be used for the energy storing means such as spring-elastically yielding elements, or mechanical or pneumatic springs.

The essential feature of the invention is that one common energy-storing element is provided for two oscillating members, for instance for the reed and the filling insertion means. This is possible because the motions of the filling insertion means and of the reed overlap very little or not at all. Due to the use of the above-mentioned double cams for the sley drive, the sley is locked in place during the filling insertion motion and, vice versa, the filling insertion means are motionless during the reed beat-up or slinging motion and therefore the filling insertion means are considered locked during the reed slinging motion. No special locking means or special control devices to release the locked members are required, contrary to German Patent Publication No. 2,808,202. The energy-storing element is connected only to the two associated oscillating or moving members and does not require any fixed connection point in the machine frame. Only a slight expenditure for construction is required because there is one common energy-storing element for two moving or oscillating means.

The invention does not require that the spring element be in its unstressed state, at the precise central position of the oscillating or moving members, but rather this unstressed state can be set at a more or less pronounced deviation from the geometric center, depending upon the particular requirements.

The invention achieves a substantial reduction in the magnitude of the forces which must be applied and, therefore, a saving of energy as well as a smoother running of the machine. Advantageously, the spring energy-storing element is so dimensioned that the energy it takes up and stores in the end positions of the oscillating motion essentially corresponds to the acceleration and deceleration forces respectively produced in those end positions at the beginning and at the end of the oscillating motion. Ideally it is therefore possible to eliminate the above-mentioned undesired rotational non-uniformity caused during the machine operation by the required accelerating and decelerating forces. Moreover, the invention also applies and can be adapted where accelerations and decelerations of different magnitudes are desired in the end position zones of the oscillating motions and also where different times of reversal, and even different stoppage times, are desired.

Even where weight compensation is used, in a known manner, in the mentioned machines, it is possible using the present invention to reduce or substantially avoid the accelerating and decelerating forces. Furthermore, the invention permits a more rapid motion of the oscillating members, for instance of the reed, already when starting up the machine whereby the danger of start-up defects in the fabric is reduced.

Basically the invention with its system of arrangement of one spring element for cooperation with two moving components for relieving the drive, can be used in all power means in which a constantly rotating drive powers a a back and forth oscillating motion, for instance for a crank drive. The spring means can be arranged singly or, if required, also severally, for instance, one spring means each at both ends of a reed shaft, just as the drive can be divided among several excenter cams or double cams.

BRIEF DESCRIPTION OF THE DRAWINGS

The invention will be further illustrated by reference to the accompanying drawings, in which.

DETAILED DESCRIPTION OF PREFERRED EXAMPLE EMBODIMENTS AND OF THE BEST MODE OF THE INVENTION

Figure 1:
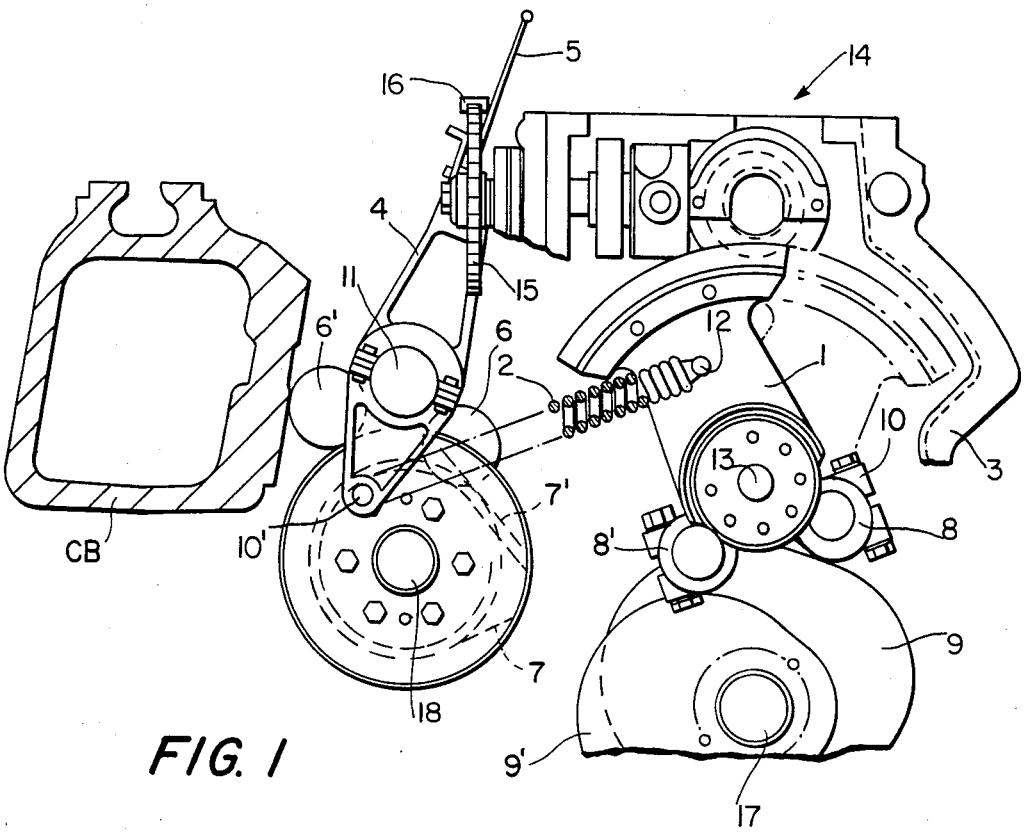
FIG. 1 shows a drive means for gripper rods and for the reed shown in the filling insertion position with a mechanical spring according to the invention.

First the construction of the drive means for the filling insertion devices and for the reed will be discussed. FIG. 1 shows only the most important components. Part of the machine frame or housing 13 is shown in simplified form. A cross beam CB forming part of the machine frame is also shown in the left-hand part of each figure to provide a general orientation for the location of components. Two excenter cams 9 and 9' acting as a double cam are mounted on a continuously rotating main shaft 17 and the curvature of each cam 9, 9' is followed by a respective sensing roller 8 and 8'. The sensing rollers 8 and 8' are mounted to the ends of a double arm pivot lever 10 tiltable about a journal bearing 13 and rigidly coupled to a gear sector lever 1 forming a moving or oscillating member. The pivot lever 10 and the gear sector lever 1 perform a rocking motion due to the curvature of the excenter cams 9 and 9'. The two end positions of the rocking motion of the gear sector lever 1 are shown in solid lines for the advanced position of the filling insertion devices and in phantom lines for the retracted position of the filling insertion devices. A gear rim mounted on the gear sector lever 1 engages an intermediate gear 14, not shown in further detail, which transmits the rocking motion of the lever 1 to a pinion 15. The pinion 15 engages the toothed part of a gripper rod 16, shown in cross-section. The rocking motion of the gear sector lever 1, which takes place in the plane of the drawing, therefore is converted into an advancing and retracting motion, perpendicular to the plane of the drawing, of the gripper rod 16. The system corresponds, up to this point, to the state of the art initially cited wherein all of the forces for the rocking motion must be produced by the excenter cams.

The reed drive will now be described. This drive itself is powered by a constantly rotating shaft 18 through a double cam drive similar to the cams 9, 9'. Two excenter cams 7 and 7', which are parts of the double cam drive, are mounted on the shaft 18. Sensor rollers 6 and 6' are mounted by means of an oscillating lever not shown in further detail on the sley shaft 11 and impart a back and forth rocking motion to the reed 5 pivotally mounted on the sley shaft 11 by means of a rocking arm 4.

Figure 2:
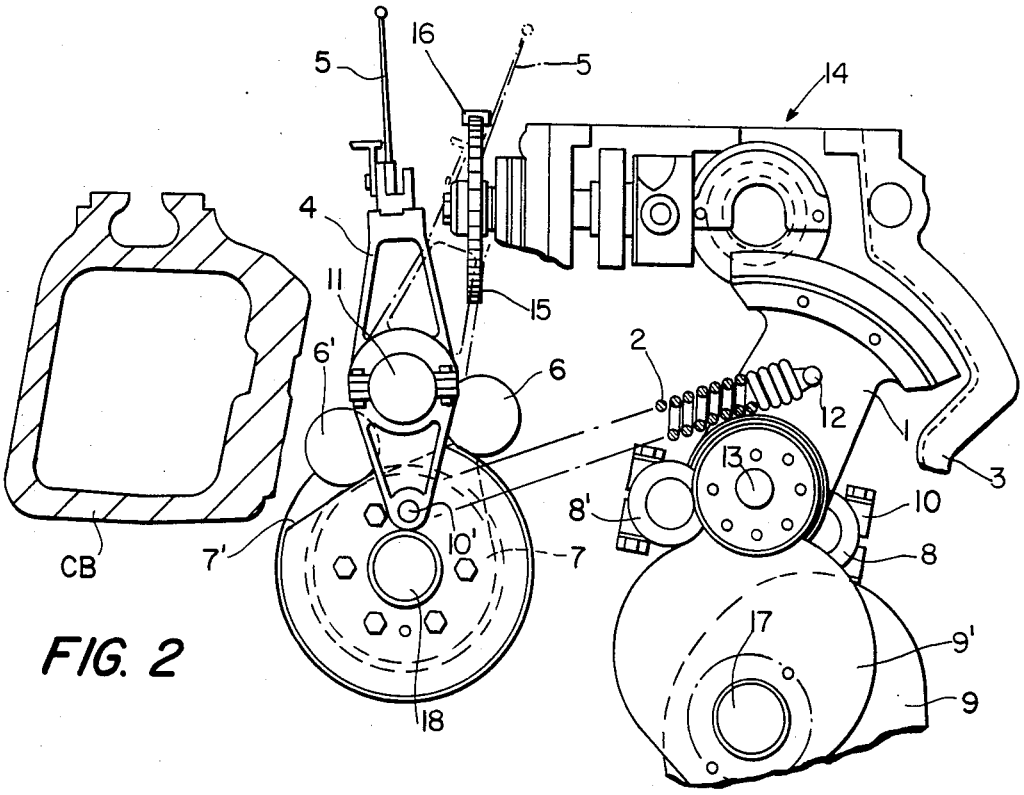
FIG. 2 shows the drive means of FIG. 1 in the reed beat-up or slinging position.

FIG. 2 shows the beat-up or slinging position of the reed 5 in solid lines and the rear rest position thereof in phantom lines. The rocking arm 4 carries the reed 5 at one end and is connected at its other end to a spring element 2 acting as an energy storing device, as will be further discussed below. By using double cams 7, 7' and 9, 9' in the cam drives, return springs are eliminated for the moving members. These double cams also eliminate chattering or interfering detachment of the sensing rollers 6, 6' and 8, 8' from the associated cams 7, 7' and 9, 9'.

Parts of each of the two drive means, for instance for the reed 5 and the gear sector lever 1, oscillate in the same planes or at least in parallel planes. A spring element 2, in this illustrative embodiment of the invention a helical spring 2, is used as the energy storing means between the two moving members 1, 4. As mentioned above, one of the ends of the spring 2 is connected to point 10' of the rocking arm 4. The other end of the spring 2 is connected to point 12 of the gear sector lever 1. The coil spring 2 is an energy storage device common to both moving drive members 1 and 4 for the gripper rod motion and the reed beat-up or slinging motion. This is possible because the two motions of the gripper rod drive and the reed drive overlap in time not at all or only very little.

The operation of the system of the invention now will be described. In relation to FIG. 1 it is first assumed that a filling yarn is inserted by a gripper rod 16 into the loom shed. The gripper sector lever 1 is displaced by the double cams 9, 9' from its position shown in phantom lines into the position indicated by the solid lines. THe gripper rod 16 is advanced by intermediate gear means 14 into the shed. During this time the cam drive 6, 6' and 7, 7' for operating the reed is in its stop position, whereby simultaneously the reed 5 remains in the rest position as shown in FIG. 1. The reed 5 is locked by means of the complementary double cams 7, 7' for all practical considerations. Hence the connection point 10 for the helical spring 2 at the rocking arm 4 acts in the manner of a stationary machine point at this time, whereas the other connection point 12 of the spring to the gear sector lever 1 executes a motion. At the beginning of the filling insertion, the gear sector lever 1 was—as already mentioned—in the phantom line position. Thereby, the spring 2 was tensioned between its two connection points 10 and 12. When the gear sector lever 1 is pivoted out of its initial position, the spring 2 relaxes and hence reinforces the drive force exerted by the cam drive 8, 8' and 9, 9' on the gripper drive. The spring 2 is fully relaxed when the gear sector lever 1 assumes a middle position, while it becomes compressed as the gear sector lever 1 moves further. The spring 2 assists in decelerating the advance of the gripper rod 16. The energy so absorbed is stored in the spring 2 for a short time, that is until the gripper rod 16 has been advanced into the loom shed, and assists the motion of the gripper rod 16 on its return stroke. At the end of a full cycle of the back and forth motion of the gear sector 1, the spring 2 is again under tension.

Upon further rotation of the main drive shaft 17, the shape of the double cams 9 locks the gear sector lever 1 and the connection point 12 for the spring 2 will temporarily act as a fixed point for the duration of the reed beat-up or slinging motion now beginning. FIG. 2 shows this case. The cam drive 6, 6' and 7, 7' ends the stop position thereof and moves the reed 5 from the phantom line position into the position shown in solid lines for the beat-up or slinging motion. Simultaneously, the energy stored in the spring 2 at the beginning of the motion reinforces the acceleration of the reed 5. During the reed beat-up or slinging motion, the spring 2 passes from the initially tensioned position thereof through the relaxed middle position into the compressed position for the foremost position of the reed 5. In this case also, the spring 2 absorbs part of the kinetic energy of the reed beat-up or slinging motion and stores it until the reed 5 swings back. The gear sector lever 1 for the gripper drive remains locked or stationary during the entire time of reed beat-up or slinging motion.

Because the tilting angles of the gear sector lever 1 and of the reed 5 may be different, advantageously the distances between the particular connection points 10 and 12 from their associated points of rotation will be made adjustable. It is also possible to store different quantities of energy at the particular end positions of the spring arrangement.

Figure 3:
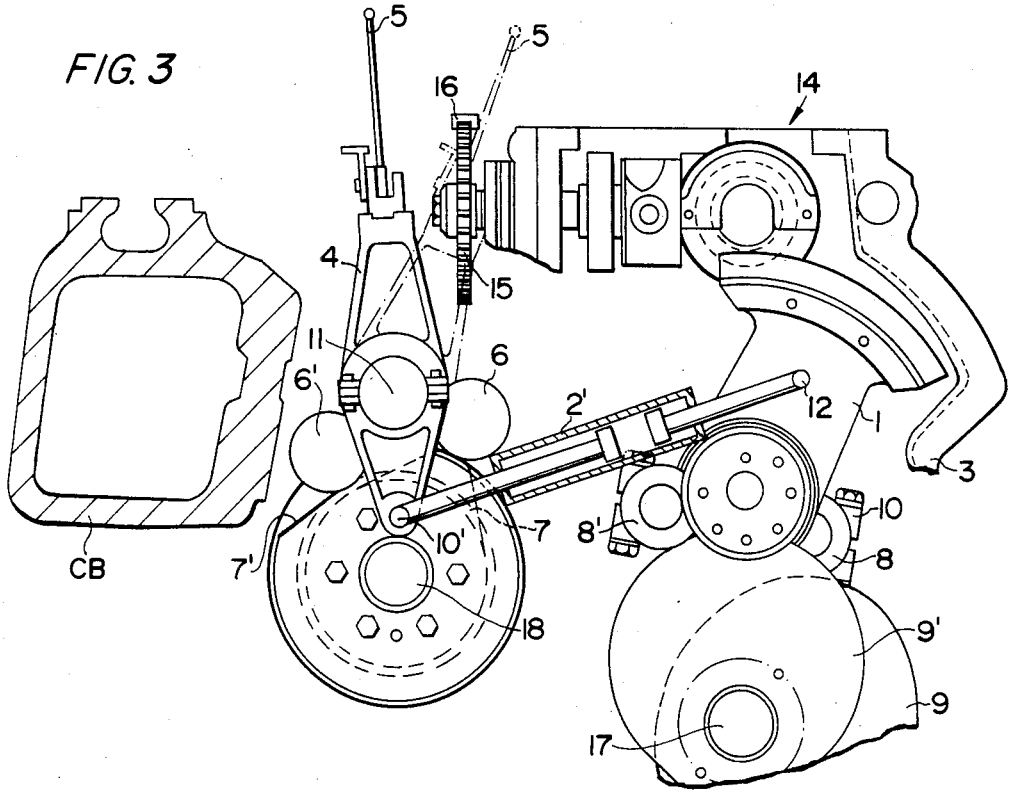
FIG. 3 is the same as FIG. 2, however, with the mechanical spring replaced by a pneumatic spring.

Furthermore, the basic concept of the invention, namely to provide a common energy storage means for two oscillating or rocking components, can also be implemented with spring elements other than helical springs. Illustratively, torsion bar springs or pneumatic springs or compressed-air springs as shown in FIG. 3 can be employed.

It will be appreciated by those skilled in the art that many modifications may be made within the scope of the present invention without departing from the spirit thereof, and the invention includes all such modifications.

What I claim is:

1. A system for relieving drive means of a weaving machine having separate components with different functions, comprising first and second separate and different drive means each including a respective different moving member for driving a respective one of said separate components having a different function alternatingly back and forth between two end positions, a single energy storing means (2) having two ends, one end of said energy storing means being connected to one of said different moving members, the other end of said energy storing means being connected to the other different moving member, and wherein the alternating motions of said different moving members are substantially free of overlap in their back and forth movement.

2. The system according to claim 1, in which said energy storing means is a compressed-air spring.

3. The system of claim 1, wherein said separate moving members are two rocking members for alternatingly rocking back and forth between said two end positions.

4. The system according to claim 1, wherein said weaving machine comprises reciprocatable filling insertion means, and wherein said single energy storing means comprises a spring means (2) connected at one end to one of said moving members provided for said filling insertion means (16), said spring means being connected at the other end to said other moving member forming a reed support (4).

5. The system according to claim 4, in which said energy storing spring means is a helical spring.

* * * * *